United States Patent [19]

Schembri

[11] Patent Number: 4,611,100

[45] Date of Patent: Sep. 9, 1986

[54] BUNCHING BLOCK FOR MCCULLOH CIRCUITS AND METHOD OF OPERATION

[75] Inventor: John J. Schembri, Daly City, Calif.

[73] Assignee: Pacific Bell, San Francisco, Calif.

[21] Appl. No.: 664,240

[22] Filed: Oct. 24, 1984

[51] Int. Cl.[4] ..... H04B 3/46

[52] U.S. Cl. ..... 179/175.3 F

[58] Field of Search ..... 179/175.3 F, 175, 175.1 R, 179/175.25, 175.3 R, 5 P; 178/69 R, 69 G; 370/13, 14, 16; 371/22; 324/52; 340/514

[56] References Cited

U.S. PATENT DOCUMENTS

| | | | |
|---|---|---|---|
| 3,848,241 | 11/1974 | LeNay et al. | 340/214 |
| 3,852,718 | 12/1974 | DeLyria | 340/164 R |
| 3,982,242 | 9/1976 | Sheffield et al. | 340/409 |
| 3,983,338 | 9/1976 | Mathauser | 179/175 |
| 4,253,091 | 2/1981 | Frydman | 340/506 |

*Primary Examiner*—Stafford D. Schreyer

*Attorney, Agent, or Firm*—Fitch, Even, Tabin & Flannery

[57] ABSTRACT

A bunching block and method of operation is disclosed wherein the bunching block is adapted for use in a public utility central office to interconnect a plurality of user loops in series with a supervisory McCulloh receiver, the bunching block including separate connectors for respective connection in series with the receiver and with the respective user loops, separate switches having a normal operating position for connecting the user loops in series with the receiver, the switches being selectively operable at the public utility central office for facilitating rapid location of a fault in the series interconnected user loops. With a number of bunching blocks being employed in series at different central offices, additional switches are preferably provided which operate similarly for selectively isolating all of the user loops in a respective central office from the series connection with the McCulloh receiver.

19 Claims, 5 Drawing Figures

BUNCHING BLOCK FOR MCCULLOH CIRCUITS AND METHOD OF OPERATION

BACKGROUND OF THE INVENTION

The present invention relates to a bunching block for use in public utility central offices and more particularly to such a bunching block employed in connection with a McCulloh circuit while being operable at the public utility central office for facilitating location of faults in one or more series interconnected user loops.

McCulloh circuits are widely employed for connection through public utility telephone lines or the like to various subscriber alarm units and associated McCulloh transmitters.

Such circuits are well known and are described for example in U.S. Pat. No. 3,848,241 issued Nov. 12, 1974 and U.S. Pat. No. 3,982,242 issued Sept. 21, 1976. These references are typical of a number of publications disclosing various features and operating characteristics of McCulloh circuits. Accordingly, those references are cited herein as being representative of a relatively large number of disclosures in connecting with McCulloh circuits.

The arrangement and operation of such McCulloh circuits are described briefly below in order to provide a better understanding of the present invention.

Generally, the alarm units may be adapted for a number of applications including fire and/or burglary for example. The alarm units and associated McCulloh transmitters are commonly connected in series and may, for example, include a normally closed switch in series with the line of an individual user loop and a normally open switch connected to ground. The switches are activated by means of a code wheel or the like in a particular sequence commonly responsive to operation of an associated alarm sensor.

When an alarm event occurs, the code wheel rotates and operates the switches, thereby providing a coded set of pulses. Each wheel has different configurations of teeth or cogs to establish a particular set of pulses as a unique code, the pulses being transmitted to a McCulloh receiver which identifies the locations of the alarm from the unique code.

Through this arrangement, large numbers of individual user loops may be connected with a single McCulloh receiver. Commonly, the McCulloh receiver is located at an installation of an alarm company or the like responsible for monitoring the individual user loops and determining if a response is necessary to a coded signal from any of the user loops. In order to assure reliable and continuous service, these monitoring companies typically employ various types of monitoring equipment for determining conditions in the individual user loops. For example, the reference patents cited above each describe different types of test and integrity equipment adapted for use by such a monitoring company to detect various conditions within the individual loops. However, it is again noted that the present invention is concerned with the configuration and operation of bunching blocks provided by a public utility or telephone company for interconnecting the individual user loops with the McCulloh receiver of the monitoring company. Accordingly, equipment of the type referred to immediately above, which is used in conjunction with the McCulloh receiver, is not contemplated as being part of the present invention.

In normal use, relatively large numbers of user loops are interconnected with the McCulloh receiver through lines provided by the telephone company. Because of this arrangement, the telephone company has a separate function of assuring continuity in the connections for the various user loops with the McCulloh receiver. Commonly, relatively large numbers of user loops at a single central office are interconnected in series with each other and with the McCulloh receiver by a bunching block including sets of first and second connectors, the first connectors being coupled with the respective individual user loops, the second connectors providing the series connection with each other and with the McCulloh receiver through external transmission lines. In the past, the first and second sets of connectors have been hard wired together in order to place the individual user loops in series with the McCulloh receiver.

Typically, large numbers of user loops associated with different central offices are first interconnected in series with bunching blocks of the type described above at the individual central offices. The multiple bunching blocks are then also connected in series with each other and with the McCulloh receiver through the external transmission lines.

In any event, whether a single central office or multiple central offices are connected with the McCulloh receiver, it is often necessary for the public utility or telephone company to locate a fault appearing anywhere in a user loop or associated circuitry anywhere along the series connection with the McCulloh receiver.

In the past, it has been common practice to employ a relatively involved manual procedure for isolating such faults. The excessive time and expense in locating faults by these procedures is emphasized by the following summary of steps carried out in the procedure. Furthermore, where bunching blocks multiple central offices are interconnected with each other and with a single McCulloh receiver, it is furthermore necessary to perform the following procedure at each of the central offices or bunching blocks until the fault is located and corrected. The prior art procedure carried out at the bunching block of each central office is as follows:

1. The individual user loops to be tested for possible faults are disconnected from the respective bunching block and from the McCulloh circuit one at a time.
2. The tip and ring connectors employed in the bunching block for connecting the individual user loops in series with the McCulloh circuit are then shorted out in order to individually isolate the respective user loops.
3. A remote test device commonly referred to as a shoe is then installed in place with the tip and ring connectors in the bunching block for the respective user loops to permit testing as described above.
4. After testing with each individual user loop being isolated, hard wiring is again installed between the first and second connectors for the respective user loop.
5. The short is then removed from the tip and ring connector as described above.
6. The above steps are repeated in connection with each individual user loop or with multiple individual user loops if necessary in order to locate the fault. As was also noted above, this entire procedure must be continued if necessary through the bunching blocks in all of the central offices connected in series with the McCulloh receiver until the fault is located.

The time and expense thus required by the telephone company to locate faults in equipment served by the bunching blocks at various central offices is readily apparent from the preceding description.

Accordingly, there has been found to remain a need for an improved method and apparatus for facilitating the rapid location of a fault or faults in the individual user loops connected in series with a McCulloh test circuit.

SUMMARY OF THE INVENTION

It is therefore an object of the invention to provide an improved configuration for a bunching block adapted for use in a public utility central office to interconnect a plurality of user loops in series with each other in a McCulloh circuit and a method for operating such a bunching block in order to overcome one or more problems of the type referred to above.

It is a more specific object of the invention to provide such a bunching block apparatus and method of operation wherein separate switch means integrally provided within the bunching block may be rapidly operated in order to facilitate location of a fault in one or more of the series interconnected user loops.

It is a further object of the invention to provide such a bunching block and method of operation wherein the bunching block includes a plurality of sets of first and second contacts, first tip and ring contacts being connected with opposite sides of a respective user loop, the second tip and ring connectors being adapted for providing the series connection for the individual user loops with the McCulloh receiver, an individual switch being associated with each set of contacts and normally operable for interconnecting the first and second tip and ring connectors to place the respective user loops in series with the McCulloh receiver, the individual switches being selectively operable in order to effectively produce a short between the second tip and ring connectors in order to momentarily isolate the respective user loop for facilitating rapid location of a fault in the series connected user loops.

It is yet another object of the invention to provide a similar bunching block at each of a number of public utility central offices, the bunching blocks in the respective central offices and their individual user loops all being interconnected in series with a single McCulloh receiver.

It is a further related object of the invention to provide such an arrangement of multiple bunching in respective central offices, each of the bunching blocks including switch means of the type referred to above. Even more preferably, each of the bunching blocks is also provided with a master switch which is similarly operable either to place all of the user loops associated with that bunching block in series with the McCulloh receiver or to isolate all of the user loops associated with the particular bunching block. In this manner, the invention further facilitate a rapid determination as to whether a fault is located in one of the user loops for a particular bunching block and central office.

Additional objects and advantages of the invention are made apparent in the following description having reference to the accompanying drawings.

DESCRIPTION OF THE PREFERRED EMBODIMENTS

Figure 1:
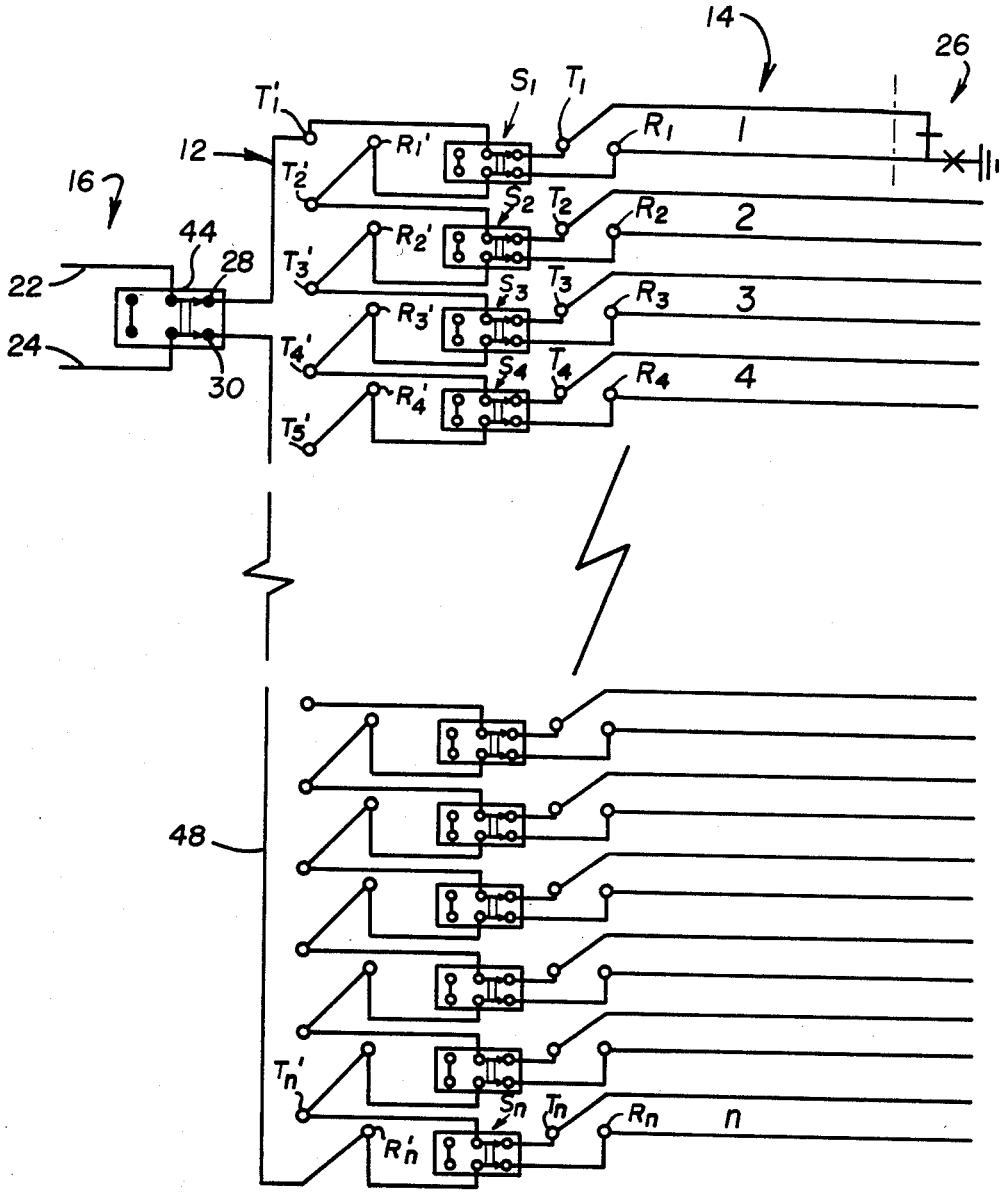
FIG. 1 is a schematic representation of a bunching block constructed in accordance with the present invention and adapted for operation in accordance with the method of the invention.
Figure 2:
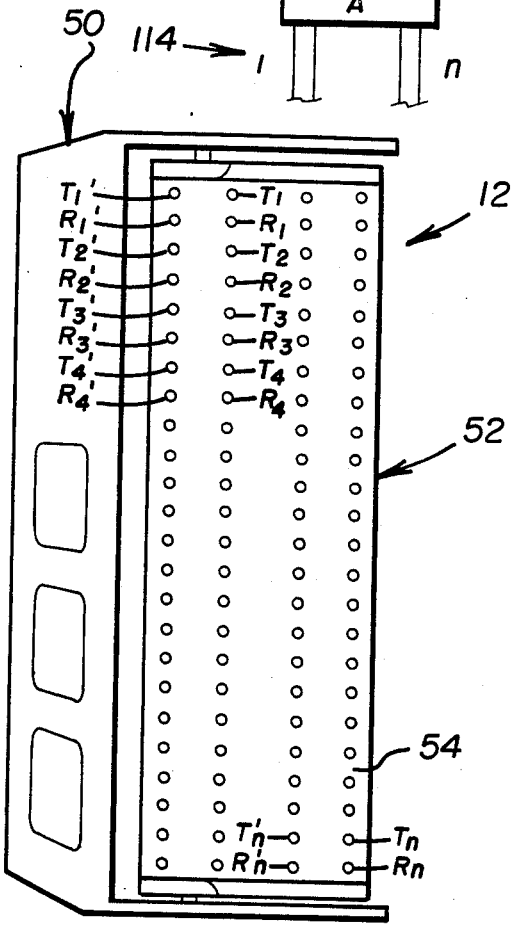
FIG. 2 is generally a plan view of the bunching block constructed in accordance with the present invention while illustrating one side or surface of a mounting panel on which a plurality of contact sets are arranged for interconnecting with respective user loops and an external McCulloh receiver.
Figure 3:
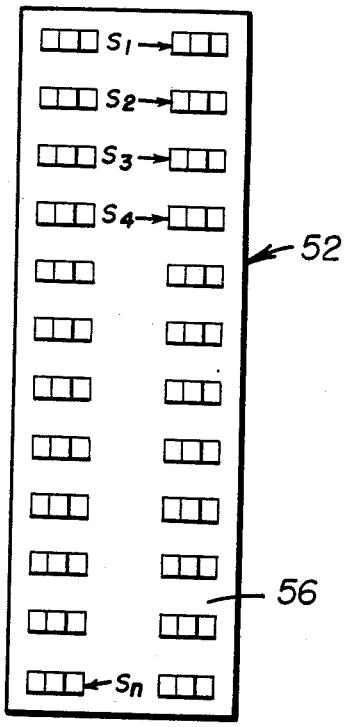
FIG. 3 is a fragmentary view of an opposite side or surface of the mounting panel of FIG. 2 in order to better illustrate individual switches adapted for operation in connection with the respective sets of contacts illustrated in FIG. 2.

Referring now to the drawing and particularly to FIGS. 1–3, a bunching block is generally indicated at 12 for providing a series connection of multiple individual user loops 14 with an external McCulloh circuit partially indicated at 16 in FIG. 1. A variation of the McCulloh circuit is illustrated in greater detail at 16' in FIG. 4 while also illustrating a McCulloh receiver 18 located in a separate facility of an alarm company, for example, as indicated at 20.

Figure 4:
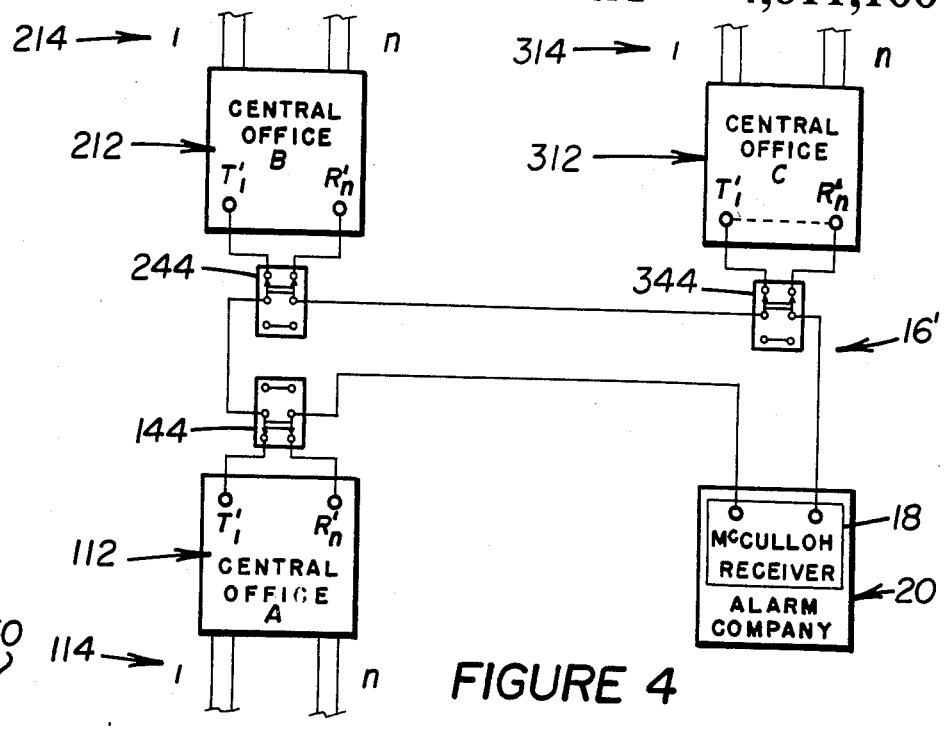
FIG. 4 is an enlarged fragmentary view of a single set of contacts and an associated switch as contemplated by the present invention in the construction and method of operation of the bunching block.

In any event, the bunching block 12 of FIG. 1 serves to interconnect the user loops 14 in series with each other and with a McCulloh receiver such as that indicated 18 in FIG. 4 through the McCulloh circuit 16 including external transmission lines 22 and 24.

Continuing with reference to FIG. 1, the bunching block 12 includes first and second sets of tip and ring connectors which are operable for placing the user loops 14 in series connection with the transmission lines 22 and 24 of the McCulloh circuit 16 as well as for placing in series connection with the McCulloh receiver. As indicated in FIG. 1, the individual user loops 14 are indicated respectively at (1), (2), (3), (4), etc. It will be apparent that any number of user loops 14 may be interconnected with one or more bunching blocks such as that indicated at 12 in FIG. 1 in a single central office. As illustrated in FIG. 1, the user loops continue through a final loop indicated at (n).

The respective sets of contacts associated with each of the user loops include first tip and ring connectors indicated respectively at T and R. The first tip and ring connectors T and R are respectively connected with opposite sides of the respective user loops. For example, the first tip and ring connectors in the first set of connectors are indicated respectively at $T_1$ and $R_1$ for connection with opposite sides of the user loop (1).

The first user loop (1) is also schematically illustrated as being connected with conventional McCulloh transmission equipment 26 including a code wheel (not shown) and the like as noted above. The other user loops are of course connected with similar McCulloh transmission equipment (not shown) for purposes of simplicity.

Each respective pair of contacts also includes second tip and ring connectors indicated respectively at T' and R'. For example second tip and ring connectors $T'_1$ and $R'_1$ are associated with first tip and ring connectors $T_1$ and $R_1$. Similar sets of first and second tip and ring connectors are similarly provided for each of the additional user loops. For example, in FIG. 1, the last user loop is indicated at (n) as noted above and is connected with first tip and ring connectors $T_n$ and $R_n$. Second tip and ring connectors $T'_n$ and $R'_n$ are associated with the first connectors $T_n$ and $R_n$.

As is illustrated in FIG. 1, each of the second ring connectors R' is connected with the second tip connector T' for the subsequent user loop. For example, the second ring connector $R'_1$ is connected with the second tip connector $T'_2$. The second ring connector $R'_2$ is connected with the third tip connector $T'_3$. In this manner, the second tip and ring connectors T' and R' are adapted for interconnecting the individual user loops 14 in series with each other and with the external McCulloh circuit 16 in a manner described in greater detail below.

As was noted above, bunching blocks including first and second tip and ring connectors as described above were also employed in the prior art. As noted above, the prior art contemplated hard connections between the first and second tip and ring connectors in order to interconnect the individual user loops 14 with the McCulloh circuit 16.

In order to facilitate location of faults in one or more of the individual user loops 14, the present invention contemplates individual switches S associated with each of the sets of first and second tip and ring connectors T, R and T', R'. The switches S are of similar construction as is illustrated in greater detail in FIG. 5 and described below.

Figure 5:
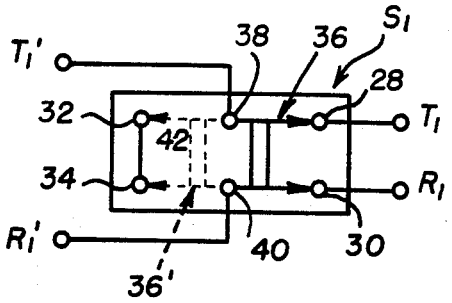
FIG. 5 is a generally schematic representation of a number of similar bunching blocks arranged in separate central offices while being interconnected in series with each other and with a single McCulloh receiver located at an alarm company installation separate from the central offices.

Referring also to FIG. 5, the switch illustrated therein is also indicated $S_1$. FIG. 5 also includes the first and second tip and ring connectors $T_1$, $R_1$ and $T'_1$, $R'_1$ to better indicate the manner in which the switches S are associated with the sets of contacts in the bunching block 12. Continuing with reference to FIG. 5, each of the switches S includes first switch contacts 28 and 30, second switch contacts 32 and 34 and a movable switch element 36 coupled with switch poles 38 and 40. As is illustrated in FIG. 5, when the bunching block 12 (see FIG. 1) is connected with the individual user loops 14 and the McCulloh circuit 16, the first switch contacts 28 and 30 are connected with the first tip and ring connectors T and R. A short is established between the second switch connectors 32 and 34 as generally indicated at 42.

The movable switch element 36 is thus preferably a double pole, double throw type switch movable between a first position indicated in solid lines at 36 and a second position indicated in phantom at 36'. With the switch element being in its solid line position illustrated at 36, the first tip and ring connectors T and R are interconnected with the second tip and ring connectors T' and R'. When the switch element is shifted to the phantom position indicated at 36', the connection between the first and second tip and ring connectors is broken and the second tip and ring connectors T' and R' are effectively interconnected with each other by means of the short 42 imposed between the second switch contacts 32 and 34.

As will be described in greater detail below, the switch element may be moved to its normal position illustrated in solid lines at 36 for interconnecting the respective user loops 14 with the McCulloh circuit 16. However, as will also be discussed in greater detail below, the individual switch elements may be selectively shifted to their alternate positions 36' in order to individually isolate the respective user loop from the McCulloh circuit 16. At the same time, shifting of the switch element for any of the switches S to the alternate position 36' serves to assure a series connection for the remaining user loops with the McCulloh circuit 16.

As is illustrated in FIG. 1, similar individual switches are provided for each of the user loops 14 and the associated sets of first and second tip and ring connectors.

An additional master switch 44 is also provided for selectively connecting the entire block of user loops 14 associated with the bunching block 12 with the McCulloh circuit 16. As will be discussed in greater detail below, the master switch 44 is similarly adapted for either normally connecting the entire block of user loops on the bunching block 12 with the McCulloh circuit 16 or isolating all of the user loops 14 from the McCulloh circuit 16 for a purpose described in greater detail below in connection with FIG. 4. In any event, in connection with the switch description set forth above with reference to FIG. 5, the first switch connectors 28 and 30 of the master switch 44 are connected respectively with the second tip connector $T'_1$ and the second ring $R'_n$ by lines 46 and 48 so that all of the user loops 14 may be normally connected with the McCulloh circuit 16 through the master switch 44.

Physical construction of the bunching block 12 is illustrated in greater detail with reference to FIGS. 2 and 3. Referring to those figures, the bunching block 12 includes a housing 50 with a mounting plate 52 being movably mounted upon the housing 50 in order to facilitate interconnection of the various first and second tip and ring connectors with other components as described in connection with FIG. 1.

In any event, the first and second tip and ring connectors for the respective user loops 14 are illustrated on one surface 54 of the mounting plate 52 as may be seen in FIG. 2. The individual switches S associated with the user loops 14 and the sets of first and second tip and ring connectors are arranged on an opposite surface 56 of the movable mounting plate 52 as is illustrated in FIG. 3.

Thus, it may be seen from FIG. 2 that the set of first and second tip and ring connectors $T_1$, $R_1$ and $T'_1$, $R'_1$ associated with the first user loop (1) is coupled with the first switch $S_1$ (see FIG. 3) in the manner schematically illustrated and described in connection with FIG. 1. The other sets of first and second tip and ring connectors are similarly interconnected with the remaining switches and may be seen with combined reference to FIGS. 1–3.

It is incidentally noted that the terms "tip" and "ring" generally have only historical significance. They are used herein only as a convenient and customary means for identifying opposite connectors which are physically similar as least in the bunching block construction contemplated by the present invention.

The method of operation for the modified bunching block 12, as illustrated in FIGS. 1–3 and 5, is believed apparent from the preceding description of the bunching block and its interconnection within the McCulloh circuit 16. However, the method of operation is further described below in order to assure a complete understanding of the invention.

Initially, all of the switches S in the bunching block 12 are normally positioned as described above so that all of the user loops 14 are interconnected in series with each other and with the McCulloh circuit 16 including the McCulloh receiver 18.

In the event of a fault arising in one of the user loops or associated components in the bunching block or the like, either the alarm company 20 will request the telephone company to initiate a determination of the location of the fault or the telephone company may initiate such an investigation on its own. In any event, the modified bunching block 12 of FIGS. 1–3 permits a rapid test to be made for locating such a fault. With an operator being located near the bunching block 12, he can be instructed to manually operate the various switches S to their alternate position in order to selectively isolate one or more of the user loops 14 from the McCulloh circuit 16. At the same time, tests can be made to determine if the fault lies within one of the isolated user loops. Primarily, such a determination primarily depends upon whether continuity exists in the remaining series connected user loops. Any sequence of the switches or combinations of the switches may thus be operated in order to isolate one or more user loops in order to rapidly determine the location of a fault in one of the user loops 14 associated with the bunching block 12 of FIG. 1.

A variation of the McCulloh circuit is indicated at 16' in FIG. 4 and includes bunching blocks 112, 212 and 312 each constructed in the manner described above for the bunching block 12 of FIG. 1. As is further illustrated in FIG. 4, the bunching blocks 112, 212 and 312 represent separate central offices A, B and C each having multiple user loops 114, 214 and 314.

Each of the bunching blocks 112, 212 and 312 similarly includes a master switch as indicated at 144, 244 and 344 respectively. These master switches are interconnected in series within the McCulloh circuit 16' so that all of the user loops associated with the three bunching blocks in the central offices A, B and C are interconnected in series with each other and with the McCulloh receiver 18.

With such a combination, the same method described above may be employed for isolating and determining the location of a fault in a user circuit. However, the master switches 44 further facilitate the location of such a fault when there are multiple central offices involved. Initially, before undertaking the method described above, the master switches 144, 244 and 344 are first operated sequentially in order to respectively and momentarily isolate all of the user loops associated with the bunching block in any given central office from the McCulloh circuit 16'. In this manner, location of the fault can be rapidly limited to one central office or the other. Thereafter, the preceding method may be followed in order to locate the fault in a specific user loop.

Accordingly, there has been described a novel bunching block construction and method of operation for facilitating rapid location of a fault in a large number of series connected user loops. Various modifications and additions are believed apparent in addition to those described above. Accordingly, the scope of the present invention is defined only by the following appended claims.

What is claimed is:

1. A bunching block adapted for use in a public utility central office to interconnect a plurality of user loops in series with each other in a McCulloh circuit for connecting the series of user loops with a supervisory McCulloh receiver means adapted for monitoring selected conditions in the respective user loops, the bunching block comprising frame means, first tip and ring connector means mounted upon said frame means and adapted for respective connection with opposite sides of the user loops, second tip and ring connector means mounted upon said frame means and associated respectively with said first tip and ring connector means, said second tip and ring connector means further being adapted for providing a series connection for the respective user loops with the McCulloh receiver means, and separate switch means associated with each set of first tip and ring connector means and said associated second tip and ring connector means, each of said separate switch means having a normal operating position for connecting said first tip and ring connector means respectively with said second tip and ring connector means to permit normal operation of the user loops in series with each other and with the McCulloh receiver means, each of said separate switch means being selectively operable for effectively shorting out said second tip and ring connector means for isolating at least one selected user loop to facilitate rapid location of a fault in the multiplicity of series connected user loops.

2. The bunching block of claim 1 wherein said first and second tip and ring connector means are arranged upon one side of a mounting plate, said separate switch means being mounted upon an opposite side of said plate means and interconnected with said first and second tip and ring connector means.

3. The bunching block of claim 2 wherein said mounting plate is movably mounted on a housing for facilitating access to said connector means and said switch means.

4. The bunching block of claim 2 wherein said separate switch means each comprise a double pole, double throw switch, said second tip and ring connector means being respectively interconnected with said double pole switch element, a first pair of switch contacts being respectively interconnected with said first tip and ring connector means, a second set of switch contacts being electrically connected with each other, said double pole element being operable into a normal position in electrical engagement with said first pair of electrical contacts, said double pole element being selectively movable into electrical engagement with said second pair of switch contacts for effectively shorting out said second tip and ring connector means and thereby isolating the respective user loop.

5. The bunching block of claim 1 being adapted for series connection with at least one additional bunching block and with the McCulloh receiver means for enabling the McCulloh receiver means to monitor selected conditions in user loops associated with said two bunching blocks, each of said bunching blocks further comprising master switch means having a normal operating position for connecting its user loops in series with the other of said bunching blocks and with the McCulloh receiver means, said master switch means being selectively operable for effectively isolating all of the user loops associated with said bunching block in order to permit a rapid determination if a fault is located therein. being adapted for series connection with at least one additional bunching block and with the McCulloh receiver means for enabling the McCulloh receiver means to monitor selected conditions in user loops associated with said two bunching blocks, each of said bunching blocks further comprising master switch means having a normal operating position for connecting its user loops in series with the other of said bunching blocks and with the McCulloh receiver means, said master switch means being selectively operable for effectively isolating all of the user loops associated with said bunching block in order to permit a rapid determination if a fault is located therein.

6. The bunching block of claim 5 wherein said separate switch means each comprise a double pole, double throw switch, said second tip and ring connector means being respectively interconnected with said double pole switch element, a first pair of switch contacts being respectively interconnected with said first tip and ring connector means, a second set of switch contacts being electrically connected with each other, said double pole element being operable into a normal position in electrical engagement with said first pair of electrical contacts, said double pole element being selectively movable into electrical engagement with said second pair of switch contacts for effectively shorting out said second tip and ring connector means and thereby isolating the respective user loop.

7. The bunching block of claim 1 wherein said separate switch means each comprise a double pole, double throw switch, said second tip and ring connector means being respectively interconnected with said double pole switch element, a first pair of switch contacts being respectively interconnected with said first tip and ring connector means, a second set of switch contacts being electrically connected with each other, said double pole element being operable into a normal position in electrical engagement with said first pair of electrical contacts, said double pole element being selectively movable into electrical engagement with said second pair of switch contacts for effectively shorting out said second tip and ring connector means and thereby isolating the respective user loop.

8. A bunching block arranged in a public utility central office interconnecting a plurality of user loops in series with each other and in a McCulloh circuit with a supervisory McCulloh receiver means in a McCulloh circuit, the receiver means being adapted for monitoring selected conditions in the respective user loops, the bunching block comprising frame means mounted in the public utility central office, first tip and ring connector means mounted upon said frame means and respectively connected with opposite sides of the user loops, second tip and ring connector means mounted upon said frame means adjacent said first tip and ring connector means, said second tip and ring connector means being connected in series with the McCulloh receiver means, and separate switch means being mounted upon said frame means in association with respective first and second tip and ring connector means, each of said separate switch means having a normal operating condition for connecting said first tip and ring connector means respectively with said second tip and ring connector means to permit normal operation of said McCulloh receiving means, each of said separate switch means being selectively operable for effectively shorting out said second tip and ring connector means for isolating at least one selected user loop to facilitate rapid location of a fault in the series of interconnected user loops.

9. The bunching block of claim 8 wherein said first and second tip and ring connector means are arranged upon one side of a mounting plate, said separate switch means being mounted upon an opposite side of said plate means and interconnected with said first and second tip and ring connector means.

10. The bunching block of claim 9 wherein said mounting plate is movably mounted on a housing for facilitating access to said connector means and said switch means.

11. The bunching block of claim 9 wherein said separate switch means each comprise a double pole, double throw switch, said second tip and ring connector means being respectively interconnected with said double pole switch element, a first pair of switch contacts being respectively interconnected with said first tip and ring connector means, a second set of switch contacts being electrically connected with each other, said double pole element being operable into a normal position in electrical engagement with said first pair of electrical contacts, said double pole element being selectively movable into electrical engagement with said second pair of switch contacts for effectively shorting out said second tip and ring connector means and thereby isolating the respective user loop.

12. The bunching block of claim 11 being adapted for series connection with at least one additional bunching block and with the McCulloh receiver means for enabling the McCulloh receiver means to monitor selected conditions in user loops associated with said two bunching blocks, each of said bunching blocks further comprising master switch means having a normal operating position for connecting its user loops in series with the other of said bunching blocks and with the McCulloh receiver means, said master switch means being selectively operable for effectively isolating all of the user loops associated with said bunching block in order to permit a rapid determination if a fault is located therein. being adapted for series connection with at least one additional bunching block and with the McCulloh receiver means for enabling the McCulloh receiver means to monitor selected conditions in user loops associated with said two bunching blocks, each of said bunching blocks further comprising master switch means having a normal operating position for connecting its user loops in series with the other of said bunching blocks and with the McCulloh receiver means, said master switch means being selectively operable for effectively isolating all of the user loops associated with said bunching block in order to permit a rapid determination if a fault is located therein.

13. The bunching block of claim 8 wherein said separate switch means each comprise a double pole, double throw switch, said second tip and ring connector means being respectively interconnected with said double pole switch element, a first pair of switch contacts being respectively interconnected with said first tip and ring connector means, a second set of switch contacts being electrically connected with each other, said double pole element being operable into a normal position in electrical engagement with said first pair of electrical contacts, said double pole element being selectively movable into electrical engagement with said second pair of switch contacts for effectively shorting out said second tip and ring connector means and thereby isolating the respective user loop.

14. In a method adapted for use in connection with a public utility central office having a bunching block for interconnecting a multiplicity of user loops in series with each other in a McCulloh circuit for connecting the series of user loops with a supervisory McCulloh receiver means adapted for monitoring selected conditions in the respective user loops, the steps comprising interconnecting opposite sides of the respective user loops with first tip and ring connector means on the bunching block, connecting second sets of tip and ring connector means associated with sequential user loops in series connection with the McCulloh receiver means, and providing separate switch means on the bunching block in association with each set of first and second tip and ring connector means, operatively said separate switch means being operable in a normal position for connecting said first tip and ring connector means respectively with said second tip and ring connector means and thereby permitting normal operation of said McCulloh receiving means, selectively operating said separate switch means and effectively shorting out said second tip and ring connector means in order to isolate at least one selected user loop and thereby facilitate rapid location of a fault in the multiplicity of series interconnected user loops.

15. The method of claim 14 wherein said first and second tip and ring connector means are arranged upon one side of a mounting plate, and wherein said separate switch means are mounted upon an opposite side of said plate means and interconnected with said first and second tip and ring connector means.

16. The method of claim 15 wherein said mounting plate is movably mounted on a housing for facilitating access to said connector means and said switch means.

17. The method of claim 14 wherein said separate switch means each comprise a double pole, double throw switch, said second tip and ring connector means being respectively interconnected with said double pole switch element, wherein a first pair of switch contacts are respectively interconnected with said first tip and ring connector means, wherein a second set of switch contacts are electrically connected with each other, said double pole element being operable into a normal position in electrical engagement with said first pair of electrical contacts, said double pole element being selectively movable into electrical engagement with said second pair of switch contacts for effectively shorting out said second tip and ring connector means and thereby isolating the respective user loop.

18. The method of claim 14 wherein the bunching block is adapted for series connection with at least one additional bunching block and with the McCulloh receiver means for enabling the McCulloh receiver means to monitor selected conditions in user loops associated with said two bunching blocks, wherein each of said bunching blocks is provided with master switch means having a normal operating position for connecting its user loops in series with the other of said bunching blocks and with the McCulloh receiver means, said master switch means being selectively operable for effectively isolating all of the user loops associated with said bunching block in order to permit a rapid determination if a fault is located therein.

19. The method of claim 18 further comprising the step of selectively operating the master switches for said bunching block and said additional bunching block for facilitating rapid location of a fault in the user loops of the associated bunching block.

* * * * *